United States Patent [19]

Tsukamoto et al.

[11] 4,155,329

[45] May 22, 1979

[54] MAGNETIC BRUSH DEVELOPING DEVICE

[75] Inventors: Takuzo Tsukamoto; Tamotsu Sakamoto; Yoshikazu Okamoto, all of Ebina, Japan

[73] Assignee: Xerox Corporation, Stamford, Conn.

[21] Appl. No.: 869,984

[22] Filed: Jan. 16, 1978

[30] Foreign Application Priority Data

Jan. 31, 1977 [JP] Japan ..... 52-9391[U]

[51] Int. Cl.[2] ..... G03G 13/09

[52] U.S. Cl. ..... 118/658; 427/18

[58] Field of Search ..... 118/653, 655, 656, 657, 118/658, 661; 427/18

[56] References Cited

U.S. PATENT DOCUMENTS

| | | | |
|---|---|---|---|
| 3,754,526 | 8/1973 | Caudill | 118/658 |
| 3,863,603 | 2/1975 | Buckley et al. | 118/658 |
| 3,890,928 | 6/1975 | Jeanmaire et al. | 118/658 |
| 3,909,864 | 10/1975 | Tanaka et al. | 118/655 |
| 3,918,402 | 11/1975 | Ohta | 118/656 |
| 3,924,944 | 12/1975 | Smith et al. | 118/655 |

OTHER PUBLICATIONS

IBM Technical Disclosure Bulletin, vol. 20, No. 1, Jun. 1977, Developer Anti-Dusting Curtain, A. H. Caudill, pp. 27, 28.

*Primary Examiner*—Mervin Stein

*Attorney, Agent, or Firm*—J. J. Ralabate; C. A. Green; H. Fleischer

[57] ABSTRACT

A development apparatus in which particles stored in a chamber of a housing are deposited on a latent image. Air flow is controlled to prevent leakage of the particles from the chamber of the housing.

4 Claims, 2 Drawing Figures

MAGNETIC BRUSH DEVELOPING DEVICE

BACKGROUND OF THE INVENTION

This invention relates generally to an electrophotographic printing machine, and more particularly concerns an improved development system for use therein.

In electrophotographic printing, a photoconductive member is charged to sensitize the surface thereof. The charged photoconductive member is exposed to a light image of an original document being reproduced. Exposure of the sensitized photoconductive surface selectively discharges the charge thereon. This records an electrostatic latent image on the photoconductive surface corresponding to the informational areas contained within the original document being reproduced. Development of the electrostatic latent image recorded on the photoconductive surface is achieved by bringing developer material into contact therewith. Typical developer materials comprise dyed or colored heat settable plastic powders, known in the art as toner particles, which are mixed with coarser carrier granules, such as ferromagnetic granules. The toner particles and carrier granules are selected such that the toner particles require the appropriate charge relative to the electrostatic latent image recorded on the photoconductive surface. Thus, when the developer material is brought into contact with the latent image recorded on the photoconductive surface, the greater attractive force thereof causes the toner particles to transfer from the carrier granules and adhere to the electrostatic latent image. This concept was originally disclosed by Carlson in U.S. Pat. No. 2,297,691 and is further amplified and described by many related patents in the art.

Various techniques have been utilized for applying the developer material to the latent image. For example, the developer material may be cascaded over the latent image and the toner particles attracted from the carrier granules thereto. Other devices employed to develop the latent image include the use of magnetic field producing devices which form brush-like tufts extending outwardly therefrom contacting the photoconductive surface. However, in all of these types of devices, it is desirable to prevent the escaping of toner powder clouds from the development system. Escaping toner powder clouds contaminate the remainder of the electrophotographic printing machine resulting in a degradation in the performance thereof.

In a typical magnetic brush development system, toner particles are dispensed into the chamber of the development housing from a toner particle cartridge. These toner particles are added in proportion to the amount consumed during the development process. The toner particles are mixed with the carrier granules by means of a mixing device such as a paddle wheel, and/or possibly a crossmixing baffle. The toner particles adhere to the carrier granules by an electrostatic force, i.e. triboelectrically. This developer material is advanced by a magnetic brush roller which includes a rotating tubular member interfit telescopically over a substantially stationary magnet. As the tubular member rotates, developer material is advanced into the development zone so that it may contact the electrostatic latent image recorded on the photoconductive surface. In a system of this type, it is necessary to control the amount of developer material adhering to the tubular member. This may be achieved by employing a metering blade. In one embodiment, the metering blade has one marginal region secured to a wall of the developer housing with the other marginal region spaced closely to the tubular member. This defines a precise gap which determines the thickness of the developer material adhering to the tubular member. However, as the tubular member rotates, it acts as a compressor producing an air flow in the direction of rotation. This forms a powder cloud which moves with the air in the direction of flow through the gap between the developer housing and the photoconductive surface. This powder cloud may then contaminate the other processing stations of the printing machine. Alternatively, the metering blade may have one end portion thereof spaced from the developer housing walls with the other end portion thereof being closely adjacent to the tubular member. In this type of an embodiment, turbulent air flow is generated which, once again, moves the powder cloud thrugh the gap between the developer housing and photoconductive member. This, toner laden powder cloud contaminates the other process stations in the printing machine.

Accordingly, it is a primary object of the present invention to improve the prevention of developer material leakage from a developer unit employed in an electrophotographic printing machine.

PRIOR ART STATEMENT

Various types of devices have hereinbefore been developed to improve the development system of an electrophotographic printing machine. The following prior art appears to be relevant:

| | | |
|---|---|---|
| Olden | 2,892,446 | 6/30/59 |
| Stavrakis et al | 2,910,964 | 11/3/59 |
| Buckley et al | 3,863,603 | 2/4/75 |
| Hanson | 3,872,826 | 3/25/75 |

The pertinent portions of the foregoing poior art may be briefly summarized as follows:

Olden describes a pair of elongated magnets disposed on either side of a trough at the point of photoconductive web entry. The magnets attract carrier granules thereto forming a brush which prevents developer mix from escaping from the housing.

Stavrakis et al also discloses a magnetic seal.

Buckley et al also describes a development system employing a pile fabric seal at one marginal region to prevent toner clouds from escaping the development housing. In addition, a blade scraper prevents toner clouds from escaping at the other marginal region of the housing.

Hanson describes developer unit seals. The top seal is a brush engaging the photoconductive surface. A pair of foam end seals also engage the photoconductive surface.

It is believed that the scope of the present invention, as defined by the appended claims, is clearly patentably distinguishable over the foregoing prior art taken either singly or in combination with one another.

SUMMARY OF THE INVENTION

Briefly stated, and in accordance with the present invention, there is provided an apparatus for developing a latent image with particles.

Pursuant to the features of the invention, the apparatus includes a housing defining a chamber for storing a supply of particles therein. Means, disposed in the chamber of the housing, deposit the particles on the latent image. Means are provided for controlling the air flow in the chamber of the housing. The air flow prevents the leakage of particles from the chamber of the housing.

BRIEF DESCRIPTION OF THE DRAWINGS

Other objects and advantages of the invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
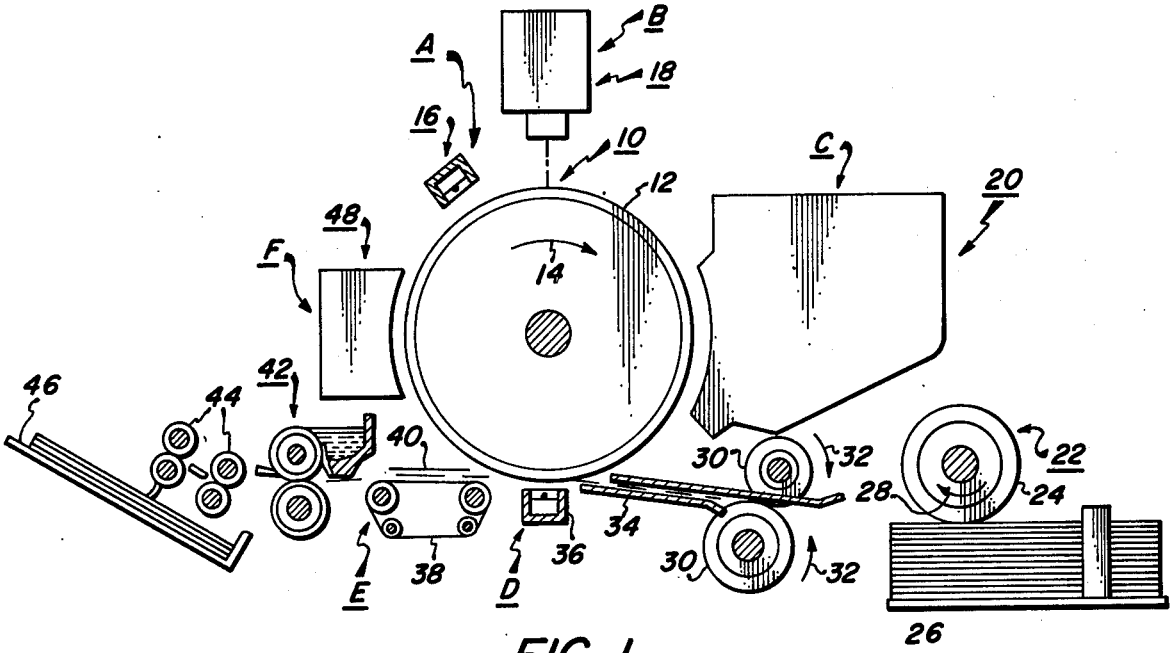
FIG. 1 is a schematic elevational view depicting an electrophotographic printing machine incorporating the features of the present invention therein.

For a general understanding of an electrophotographic printing machine in which the features of the present invention may be incorporated, reference is had to FIG. 1 which depicts schematically the various components thereof. Hereinafter, like reference numerals will be employed throughout to designate identical elements. Although the development apparatus is particularly well adapted for use in electrophotographic printing, it should become evident from the following discussion that it is equally well suited for use in a wide variety of devices and is not necessarily limited in its application to the particular embodiment shown herein.

Inasmuch as the practice of electrophotographic printing is well known in the art, the various processing stations for producing a copy of an original document are represented in FIG. 1 schematically. Each processing station will be discussed briefly hereinafter.

As in all electrophotographic systems of the type illustrated, a drum 10 having photoconductive surface 12 entrained about and secured to the exterior circumferential surface of a conductive substrate is rotated, in the direction of arrow 14, through the various processing stations. One type of suitable photoconductive material is described in U.S. Pat. No. 2,970,906 issued to Bixby in 1961. Preferably, the conductive substrate is made from aluminum.

Initially, drum 10 rotates a portion of photoconductive surface 12 through charging station A. Preferably, charging station A utilizes a corona generating device, indicated generally by the reference numeral 16, to sensitize photoconductive surface 12. Corona generating device 16 is positioned closely adjacent to photoconductive surface 12. When energized, corona generating device 16 charges at least a portion of photoconductive surface 12 to a relatively high substantially uniform potential, For example, corona generating device 16 may be of the type described in U.S. Pat. No. 2,836,725 issued to Vyverberg in 1958.

Thereafter, drum 10 rotates the charged portion of photoconductive surface 12 to exposure station B. Exposure station B includes an exposure mechanism, indicated generally by the reference numeral 18, having a stationary, transparent platen, such as a glass plate or the like, for supporting an original document thereon. Scan lamps illuminate the original document. Scanning of the original document may be achieved by moving a lens and the lamps thereacross in a timed relationship with the movement of drum 10. A mirror reflects the latent image of the original document through the lens onto a mirror, which, in turn, transmits the light image through an apertured slit onto the charged portion of photoconductive surface 12. Irradiating the charged portion of photoconductive surface 12 selectively discharges the charge thereon to record an electrostatic latent image corresponding to the informational areas contained within the original document.

Drum 10 next rotates the electrostatic latent image recorded on photoconductive surface 12 to development station C. Development station C includes a developer unit, indicated generally by the reference numeral 20, having a housing with a supply of developer material contained therein. The developer material includes carrier granules with toner particles adhering triboelectrically thereto. Developer unit 20 is a magnetic brush type of development system. In a system of this type, the developer material is brought through a directional flux field to form a brush thereof. The electrostatic latent image recorded on photoconductive surface 12 is developed by bringing the brush of developer material into contact therewith. During development, the toner particles are attracted from the carrier granules to the latent image forming a powder image on photoconductive surface 12. The detailed structure of developer unit 20 will be described hereinafter with reference to FIG. 2.

With continued reference to FIG. 1, a sheet of support material is advanced by sheet feeding apparatus 22 to transfer station D. Sheet feeding apparatus 22 includes a feed roll 24 contacting the uppermost sheet of the stack of sheets of support material 26. Feed roll 24 rotates in the direction of arrow 28 so as to advance the uppermost sheet from stack 26. Registration rollers 30, rotating in the direction of arrow 32, align and forward the advancing sheet of support material into chute 34. Chute 34 directs the advancing sheet of support material into contact with drum 10 in a timed sequence so that the powder image developed thereon contacts the advancing sheet of support material at transfer station D.

At transfer station D, corona generating device 36 applies a spray of ions to the backside of the sheet of support material. This attracts the powder image from photoconductive surface 12 to the sheet of support material. After transfer, the sheet is separated from photoconductive surface 12 and advanced by conveyor 38 in the direction of arrow 40 to fusing station E.

Fusing station E includes a fuser assembly, indicated generally by the reference numeral 42. Fuser assembly 42 permanently affixes the transferred toner powder image to the sheet of support material. After the toner powder image is permanently affixed to the sheet of support material, the sheet of support material is advanced by a series of rollers 44 to catch tray 46 for subsequent removal therefrom by the machine operator.

Invariably, after the sheet of support material is stripped from photoconductive surface 12 of drum 10, some residual toner particles remain adhering to photoconductive surface 12. These residual toner particles are removed from photoconductive surface 12 at cleaning station F. Cleaning station F includes a cleaning system, indicated generally by the reference numeral 48. The toner particles are cleaned from photoconductive surface 12 by a rotatably mounted fibrous brush in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts developer unit 20 in greater detail.

Figure 2:
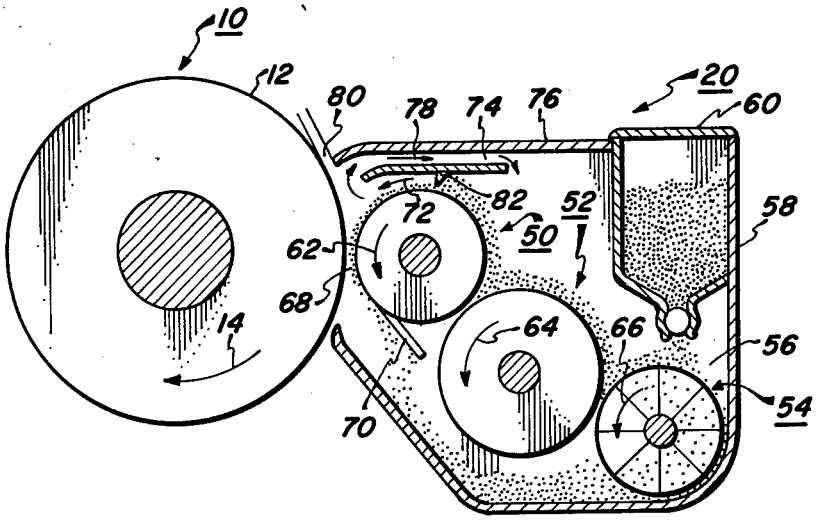
FIG. 2 is a schematic elevational view showing a development system employed in the FIG. 1 printing machine.

Turning now to FIG. 2, there is shown the detailed structure of developer unit 20. As depicted therein, developer unit 20 comprises a developer roller 50, a transport roller 52, and a paddle wheel conveyor 54. Developer roller 50, transport roller 52, and paddle wheel conveyor 54 are disposed in chamber 56 of developer housing 58. As toner particles are depleted from the developer material, toner cartridge 60 furnishes additional toner particles to chamber 56. These toner particles are dispensed over paddle wheel 54 so as to be intermixed with the carrier granules contained therein forming a fresh supply of developer material.

Preferably, developer roller 50 comprises a non-magnetic tubular member interfit telescopically over a substantially stationary magnetic rotor. The magnetic rotor is made preferably from barium ferrite with the tubular member being made from an aluminum having the exterior circumferential surface thereof roughened. A constant speed motor rotates the tubular member relative to the magnetic rotor. The tubular member of developer roller 50 rotates in the direction of arrow 62. Similarly, transport roller 52 is made from a non-magnetic tubular member interfit telescopically over a stationary magnetic rotor. A constant speed motor rotates the tubular member of transport roller 52 in the direction of arrow 64. The exterior circumferential surface of the tubular member of transport roller 52 is roughened to facilitate developer material movement.

In operation, the additional toner particles are metered from cartridge 60 onto paddle wheel 54. Paddle wheel 54 intermingles the fresh supply of toner particles with the carrier granules so as to form a new supply of developer material. Paddle wheel 54 is made preferably from a hub having a plurality of substantially equally spaced vanes extending radially outwardly therefrom. A constant speed motor rotates paddle wheel 54 in the direction of arrow 66. In this way, the toner particles are advanced to transport roller 52. Transport roller 52 rotates in the direction of arrow 64 to advance the developer material to developer 50. Developer roller 50 rotates in the direction of arrow 62 to move the developer material into development zone 68. In development zone 68, the toner particles are attracted from the carrier granules to the electrostatic latent image recorded on photoconductive surface 12 of drum 10. The residual developer material and denuded carrier granules are scraped from developer roller 50 by blade 70.

As developer roller 50 rotates in the direction of arrow 62, it acts as an impeller generating a flow of air in the direction of arrow 72. Plate 74 is interposed between wall 76 of housing 58 and developer roller 50 to control this air flow. The space between plate 72 and wall 74 defines a passageway through which the air flow passes, in the direction of arrow 78. Thus, the air flows in a recirculating path. Initially, the developer roller 50 moves the air in the direction of arrow 72. Thereafter, the air flows around plate 74 and moves in the direction of arrow 78 returning to chamber 56 of housing 58. This prevents the air from escaping through gap 80, i.e. the gap between wall 76 and photoconductive surface 12. In this manner, plate 74 acts to control the air flow in chamber 56 of housing 58 preventing the leakage of toner particles therefrom through gap 80. Thus, the leakage of toner particles as a toner powder cloud is eliminated, and the air current in the boundary layer of photoconductive surface 12 and housing 58 moves in a recirculating path in chamber 56 of housing 58 as depicted by arrows 72 and 78. This prevents the toner particles or developer material from flowing outwardly through gap 80. In this manner, contamination of of the electrophotographic printing machine by a toner powder cloud is prevented.

Metering blade 82 regulates the thickness of the layer of developer material adhering to developer roller 50. Metering blade 82 has one end portion thereof secured to an intermediate region of plate 74. The other end portion thereof is disposed closely adjacent to developer roller 50 so as to define a gap therebetween. The width of space controls the quantity of developer material adhering to developer roller 50. As depicted in FIG. 2, metering blade 82 extends in a transverse direction to plate 74.

In recapitulation, it is evident that the plate interposed between the developer roller and the wall of the housing acts to control the air flow so as to insure that the air moves in a recirculating path. This type of air flow prevents leakage of toner particles from the chamber of the housing. Thus, the air flow generated by the rotation of the developer roller is controlled so as to move in a recirculating path preventing the leakage of particles from the chamber of the housing. This insures that the toner powder cloud does not contaminate the remaining components of the electrophotographic printing machine.

It is, therefore, evident that there has been provided, in accordance with the present invention, a development system that fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing a latent image with particles, including:

a housing defining a chamber for storing a supply of particles therein;

means, disposed in the chamber of said housing, for depositing the particles on the latent image;

a plate interposed between one wall of the chamber of said housing and said depositing means so as to form a recirculating air flow path between said depositing means and said plate and between said plate and the wall of the chamber of said housing for controlling the flow of air in the chamber of said housing to prevent the leakage of particles from the chamber of said housing; and a blade having one end portion thereof secured to an intermediate region of said plate with the other end portion thereof being closely adjacent to said depositing means, said blade extending in a transverse direction to said plate.

2. An apparatus as recited in claim 1, wherein said depositing means includes:

a magnetic member; and a non-magnetic tubular member interfit telescopically over said magnetic member and being spaced from the other end portion of said blade to define a gap therebetween for metering the quantity of particles adhering to said tubular member.

3. An electrophotographic printing machine of the type having an electrostatic latent image recorded on a photoconductive member, including:

a housing defining a chamber for storing a supply of developer material comprising carrier granules and toner particles therein;

means, disposed in the chamber of said housing, for depositing the toner particles on the electrostatic latent image recorded on the photoconductive member;

a plate interposed between one wall of the chamber of said housing and said depositing means so as to form a recirculating air flow path between said depositing means and said plate and between said plate and the wall of the chamber of the housing for controlling the flow of air in the chamber of said housing to prevent the leakage of developer material from the chamber of said housing; and a blade having one end portion thereof secured to an intermediate region of said plate with the other end portion thereof being closely adjacent to said depositing means, said blade extending in a transverse direction to said plate.

4. A printing machine as recited in claim 3, wherein said depositing means includes:

a magnetic member; and a non-magnetic tubular member interfit telescopically over said magnetic member and being spaced from the other end portion of said blade to define a gap therebetween for metering the quantity of particles adhering to said tubular member.

* * * * *